US007000710B1

(12) United States Patent
Umbach

(10) Patent No.: US 7,000,710 B1
(45) Date of Patent: Feb. 21, 2006

(54) AUTOMATIC PATH GENERATION AND CORRECTION SYSTEM

(75) Inventor: Daniel T. Umbach, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 10/404,550

(22) Filed: Apr. 1, 2003

Related U.S. Application Data

(60) Provisional application No. 60/369,011, filed on Apr. 1, 2002.

(51) Int. Cl.
*E21B 47/022* (2006.01)
*E21B 44/00* (2006.01)
*G01V 3/00* (2006.01)

(52) U.S. Cl. ..... 175/62; 175/45; 175/61; 340/853.4

(58) Field of Classification Search ..... 175/61, 175/62, 40, 45; 340/853.1, 853.4, 853.6, 340/854.1; 702/9
See application file for complete search history.

(56) References Cited

U.S. PATENT DOCUMENTS 5,698,981 A * 12/1997 Mercer ..... 324/329
5,711,381 A 1/1998 Archambeault et al. ..... 175/45
5,720,354 A * 2/1998 Stump et al. ..... 175/26
5,764,062 A * 6/1998 Mercer ..... 324/329
5,904,210 A * 5/1999 Stump et al. ..... 175/45
5,923,270 A * 7/1999 Sampo et al. ..... 340/988
6,035,951 A * 3/2000 Mercer et al. ..... 175/45
6,073,079 A * 6/2000 Thomas ..... 702/9
6,102,136 A 8/2000 Archambeault et al. ..... 175/45
6,161,630 A * 12/2000 Stump et al. ..... 175/26
6,250,402 B1 * 6/2001 Brune et al. ..... 175/45
6,339,426 B1 * 1/2002 Lui et al. ..... 345/467
6,389,360 B1 5/2002 Alft et al. ..... 702/9
6,427,784 B1 8/2002 Archambeault et al. ..... 175/45
6,435,286 B1 * 8/2002 Stump et al. ..... 175/26
6,454,023 B1 9/2002 Mercer et al. ..... 175/40
6,457,537 B1 10/2002 Mercer et al. ..... 175/45
6,523,623 B1 2/2003 Schuh ..... 175/45
6,536,538 B1 3/2003 Brune et al. ..... 175/45
6,577,954 B1 6/2003 Alft et al. ..... 702/9
6,651,755 B1 * 11/2003 Kelpe ..... 175/26
6,785,641 B1 * 8/2004 Huang ..... 703/7
2002/0184235 A1 12/2002 Young et al. ..... 707/104.1
2003/0051913 A1 3/2003 Mercer et al. ..... 175/45

(Continued)

OTHER PUBLICATIONS

Paul Bourke, "Piecewise Cubic Bézier Curves," Mar., 2000, pp. 1-6.

(Continued)

*Primary Examiner*—David Bagnell
*Assistant Examiner*—Shane Bomar
(74) *Attorney, Agent, or Firm*—McKinney & Stringer, P.C.

(57) ABSTRACT

A method for generating a new or corrected horizontal underground bore path from a point below ground for use with a horizontal boring machine. In the preferred embodiment, orientation and depth measurements for a boring tool located below ground are recorded. The current position of the boring tool is determined using a previously determined position, measured orientation of the boring tool, and calculating for pipe bend characteristics. Previous measurements and determined positions are recorded to provide a map of the bore. A new path is calculated using the current position as a starting point and through predetermined critical points for the bore. Instructions for drilling the next segment of the bore are made available to an operator or to a control system for a boring machine.

32 Claims, 6 Drawing Sheets

U.S. PATENT DOCUMENTS

2004/0028476 A1 * 2/2004 Payne et al. ..... 405/184

OTHER PUBLICATIONS

Subsite Trac Management System User's Manual; Issue No.: 2.0/OP-4/00; Copyright 1998, 2000 by The Charles Machine Works, Inc., Perry, OK; pp. 1-43.

Subsite Electronics, a division of The Charles Machine Works, Inc.; "Subsite TMS Trac Management System" Code-Subsite TMS Literature CMW-305; Sep. 1998—4 pages.

Model Trac Management System Plus Literature; 2 pages.

* cited by examiner

AUTOMATIC PATH GENERATION AND CORRECTION SYSTEM

This application claims benefit of Provisional Application No. 60/369,011 filed Apr. 1, 2002.

FIELD OF THE INVENTION

The present invention relates to the field of drilling horizontal underground boreholes, and in particular to using an automatic path generation and correction system to drill a horizontal underground borehole.

SUMMARY OF THE INVENTION

The present invention is directed to a method for drilling a horizontal underground borehole. The method comprises the steps of recording an orientation of a boring tool located below ground, calculating a position of the boring tool, and calculating a bore path from the position of the boring tool to a predetermined exit point.

The invention further includes a method for drilling a horizontal underground borehole with a boring tool. The method comprises measuring a depth, pitch, and yaw of the boring tool, calculating a position of the boring tool, calculating a bore path from the position of the boring tool to the next critical point, and identifying drilling instructions for the boring tool along a next segment of the bore path.

BRIEF DESCRIPTION OF THE DRAWINGS

FIG. 6 is a logic flow diagram for automatically calculating a bore path using control points and a known measurement interval.

FIG. 9 is a logic flow diagram used to generate a new path after recording the actual drilling of pipes.

DETAILED DESCRIPTION OF THE INVENTION

Figure 1:
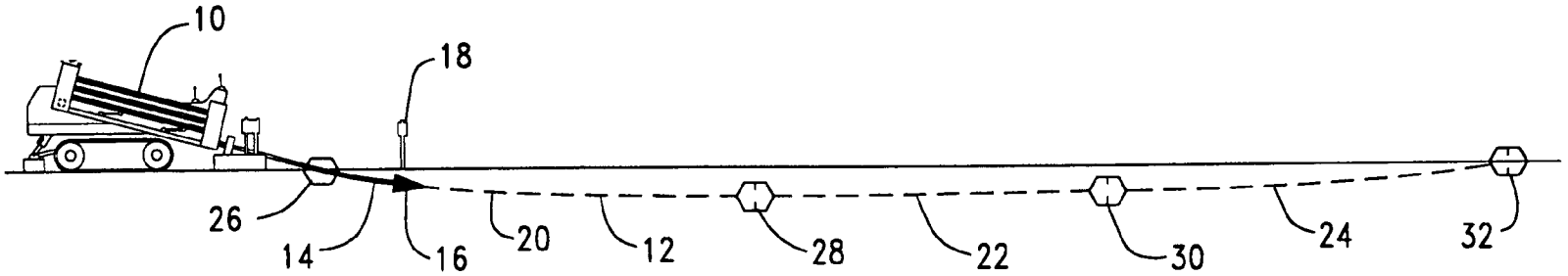
FIG. 1 is a side view of a horizontal bore path with critical points of the path identified.

Horizontal boring machines are used to install utility services or other products underground. Horizontal boring eliminates surface disruption along the length of the project, except at the entry and exit points, and reduces the likelihood of damaging previously buried products. Skilled and experienced crews in conjunction with planning and mapping systems have greatly increased the efficiency and accuracy of boring operations. However, there is a continuing need for a better way to determine the best path, or correct the path when the bore is off course, for the machine to follow and thereby increase the efficiency of boring underground.

The boring operation consists of using a boring machine to advance a drill string and a boring tool and accompanying downhole electronics through the earth along a selected path. The selected path is generally mapped in advance of the boring operation to identify the desired placement of product to be installed. The path ideally will be calculated based on a variety of parameters such as job site topography, estimated entry and exit points, location of know existing utility lines and easements, soil types, equipment capabilities, and product specifications and constraints. The selected path generally is depicted with a top view and a side view and can be created using mapping and planning applications. The operator then generally receives a "cheat sheet" or list of where each pipe or measurement point should be, including the lateral location, depth, pitch and yaw for the given point on the bore path. Skilled operators then use this sheet or list to follow the selected path using conventional steering and tracking techniques. Conventional steering techniques permit the operators to rotate and advance the drill string, and using roll orientation of the boring tool, guide the boring tool through the earth in an attempt to bore the bore path as planned. Conventional tracking techniques are used to identify the position of the boring tool at selected measurement intervals. The difficulty arises when the boring tool gets off of the selected bore path and the operator can no longer rely on the sheet or list to dictate where the next interval of drilling should end.

Currently, crews of skilled operators and assisting personnel are required to determine for themselves the proper method to then complete the bore or to try and start over. A standard technique for crews and other existing systems is to force the boring tool back on path as quickly as possible when the current position is found to be in error from the planned path. The present invention provides advantages over previously used planning and mapping systems because it automatically generates a new path through the critical points of a bore each time a new position for the boring tool is recorded. Additionally, the present invention generates a new set of drilling instructions for the next drilling segment or interval and provides those to an operator or control system for use in continuing to bore the borehole.

The present invention provides an automatic path generation and correction system used to drill a horizontal underground borehole. In a preferred embodiment, the automatic path generation and correction system comprises establishing critical points for a bore path, generating a bore path through the critical points using measurement intervals, recording the actual position of pipes drilled, and automatically generating a new or corrected path through the critical points. Establishing the critical points comprises retrieving information about specific points on the bore path that must be maintained and is generally done in advance of the bore when a survey of the bore area is accomplished. The automatic path generation process comprises calculating the path using a Bezier spline with four control points and segmenting the path into measurement intervals by integrating along the path. For each measurement interval the location, pitch, and yaw at the end of each interval is determined. The position of pipes drilled can be recorded by determining the end position of each measurement interval based upon position, pitch, and yaw information and plotting that position on a map. Automatic regeneration of the path through the critical points comprises using the position of the last recorded measurement and automatically calculating a new path through the remaining critical points using the same path generation method of a Bezier spline with measurement intervals. This method provides for a corrected path that will meet the criteria for the original plan, but without forcing the boring tool back to the original path.

The invention also comprises issuing drilling instructions for a next segment of the corrected bore path. Preferably, the next segment of the path will comprise the next measurable drilling interval. Providing the drilling instructions comprises identifying a next segment of the generated path and providing information for advancing the boring tool to the next measurement point to an operator or control system for implementation. Measurements taken at the next interval are then reported to the system and the procedure can be continually repeated until the bore is completed.

With reference now to the drawings in general and to FIG. 1 in particular, there is shown therein a horizontal boring machine 10 for boring a horizontal underground borehole along a selected bore path 12. The horizontal boring machine 10 generally comprises a drill string 14, a boring tool 16 connected to a downhole end of the drill string, and one or more drives (not shown) to rotate and advance the boring tool and the drill string through the earth and along the bore path 12. The boring tool 16 is generally provided with various downhole electronics to gather information about the status and orientation of the boring tool, such as temperature, roll, pitch, and yaw. A tracking system 18 is generally used above ground to locate the position of the boring tool below ground and receive information communicated from the boring tool 16. Conventional tracking systems 18 are used to locate the boring tool 16 by identifying a location of the boring tool in a horizontal plane and then measuring the depth of the tool, thus comprising a measurable position of the boring tool along the bore path 12.

As shown in FIG. 1, the bore path 12 shown comprises a first curved portion 20, a substantially level portion 22, and a second curved portion 24 to bring the bore to completion. Conventional planning techniques for the bore path 12 comprise identifying the level portion 22 of the bore path where the utility or other product being installed will be placed. The location of the level portion 22 is identified to account for product specifications or required clearances and to avoid known obstacles. The curved portions 20 and 24 of the bore path 12 are also identified accounting for factors such as bend limitations, soil conditions, and known obstacles. With the bore path 12 planned, the horizontal boring machine 10 is located at the surface of the ground such that the boring tool 16 will enter the ground at a specific entry angle or pitch. The machine 10 then steers the boring tool 16 to change the course of the drill string 14 to bore along the desired path 12. The drill then continues and eventually comes out of the ground either back at the surface or in a pit in order to attach the product that will be pulled back through the borehole.

To avoid obstacles and account for conditions such as clearances below rivers or roads, the planned bore path usually has a plurality of critical points the bore path must pass through. With continued reference to FIG. 1, the bore path 12 shown is generated off of a plurality critical points 26, 28, 30, and 32. Preferably, the bore path 12 comprises several different critical points that may include, but not be limited to, an entry point 26, a first tie-in point 28, a second tie-in point 30, and an exit point 32. Each critical point 26, 28, 30, and 32 has specific parameters associated with it for the desired orientation of the boring tool 12 at the critical point. Orientation parameters include a target location in the horizontal plane, a target depth or elevation, a target pitch, and a target yaw. For the purposes of discussing the present invention four critical points are shown in FIG. 1, however any number of critical points may be needed to ensure the bore path 12 meets requirements.

Figure 2:
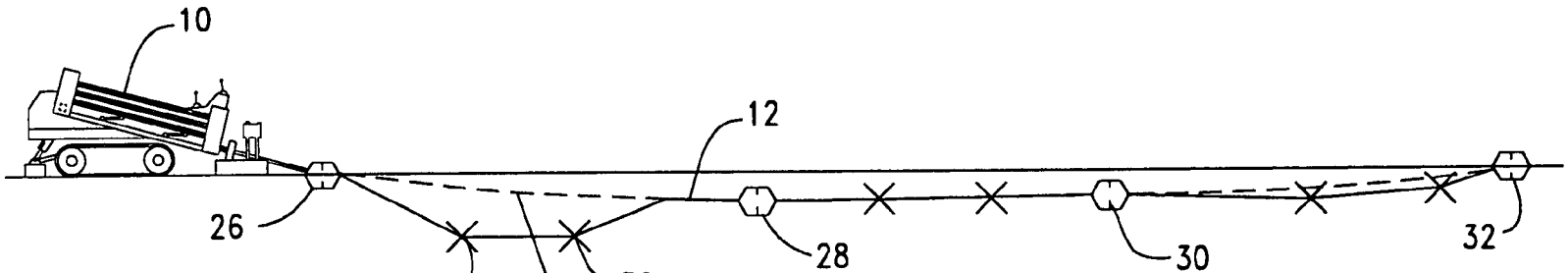
FIG. 2 is a side view of a horizontal bore path with control points used to calculate the path between the critical points.

Referring now to FIG. 2, with the critical points 26, 28, 30, and 32 identified, the method of the present invention comprises calculating the bore path 12 between the critical points using a Bezier spline. The Bezier spline is calculated with four control points, though a spline with more control points may be used to identify a smoother curved path. Preferably, two control points are the two critical points at each end of the portion of the path that is currently being generated. By way of example, in calculating the bore path for the first curved section 20 of the bore path 12 shown in FIG. 2, the end-point control points are the entry point 26 and the first below ground critical point 28. The other two control points 34 and 36 for the Bezier spline calculation are determined by first determining the distance between the two end-point critical points 26 and 28. This distance is then divided by three to give a leg length equal to one-third of the overall distance. The control points 34 and 36 are then placed by evaluating the pitch and yaw at the critical points and using polar coordinates to establish a point equal in distance to the one-third leg length along a heading equivalent to the net vector of the pitch and yaw.

To further calculate the bore path 12, the path is then divided into individual measurable segments. Preferably, the measurable segments are equivalent to how often a measurement of the boring tool and the downhole electronics will be taken. Generally in practice, this is equivalent to the length of one drill pipe of the pipes making up the drill string. However, some conditions require for measurements to be taken in smaller intervals which can be accomplished by taking measurements every one-half pipe length, every one-third pipe length, or other required length of measure.

Once this interval of measurement is established, the interval is used to establish the path 12 and the drilling instructions for each interval. This is accomplished by integrating along the calculated spline that has been established with the four control points. The spline is then evaluated at measurement points equivalent to the ratio of the measurement interval to the overall length of the spline. This is used to determine the position for each measurement interval along with the desired pitch, yaw, and depth of the boring tool at the end of the measurement interval. This evaluation step is continually repeated for each measurement interval between critical points until the path 12 is generated.

Shown below is pseudocode for the procedure for calculating the path between critical points as described above.

```
{Calculate Position Between Critical Points}
IF (Not Initialized) THEN
    Calculate Control Points
    Calculate Length of the Spline
  END IF
  Set Desired Length = Measurement Interval * Sample Number
  Set Start Pt (t0) = ((Sample Number − 1) * Measurement Interval)/
  Spline Length
  IF (Desired Length > Plan Length) THEN
    Set Desired Length = Length of the Spline
    Set Ended = true
  END IF
  Evaluate X for Start Pt (t0), finding Length in X (Lx)
  Evaluate Y for Start Pt (t0), finding Length in Y (Ly)
  Evaluate Z for Start Pt (t0), finding Length in Z (Lz)
  Set Base Length = √(Lx^2 + Ly^2 + Lz^2)
  Set End Pt (t1) = Desired Length/Length of Spline
  Evaluate X for End Pt (t1), finding ΔX , Length in X (Lx)
  Evaluate Y for End Pt (t1), finding ΔY , Length in Y (Ly)
  Evaluate Z for End Pt (t1), finding ΔZ , Length in Z (Lz)
  Set Current Length = √(Lx^2 + Ly^2 + Lz^2)
```

-continued

```
Set Result Length = Current Length − Base Length
Set Result Pitch = (tan⁻¹ (ΔZ/ΔX)
Set Result Deflection (Yaw) = (tan⁻¹ (ΔY/ΔX)
Return Value of Ended
```

Figure 3:
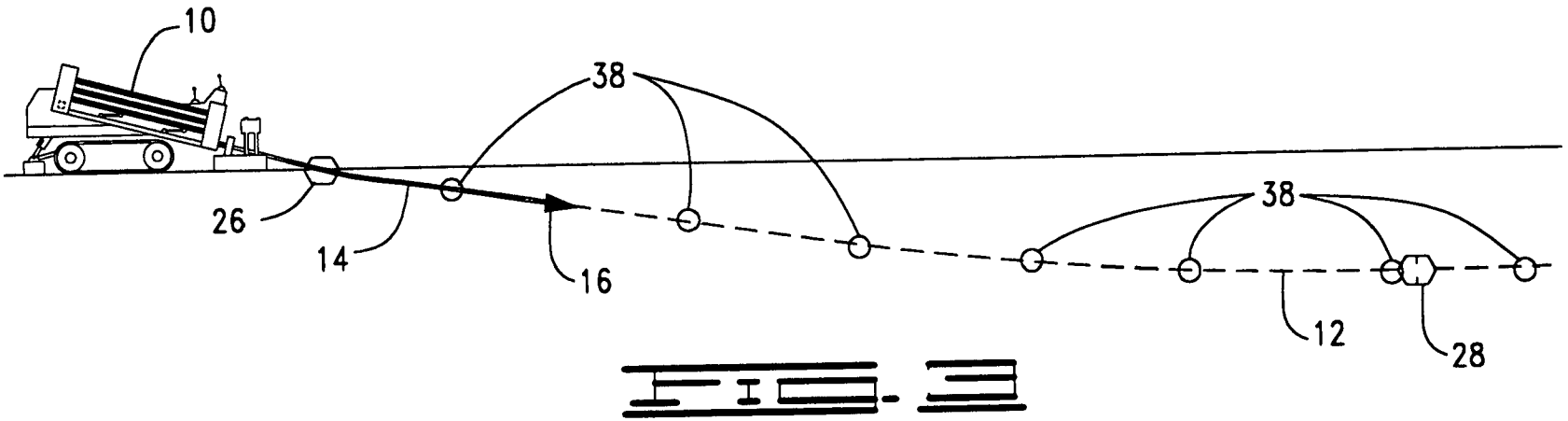
FIG. 3 is a side view of a horizontal bore path broken into segments equal to one pipe length.

There is shown in FIG. 3 a portion of a path 12 that has been calculated with a known measurement interval equivalent to one pipe length. As shown in the figure, only the first two critical points 26 and 28 for the bore path 12 are represented. Points 38 are shown representing places along the bore path 12 where depth, pitch, and yaw measurements will be taken at the boring tool 16. In an alternative embodiment of the invention yet to be described, the location, pitch, and yaw for these measurement positions 38 can also be provided or displayed for reference to the operator of the boring machine 10.

Figure 4:
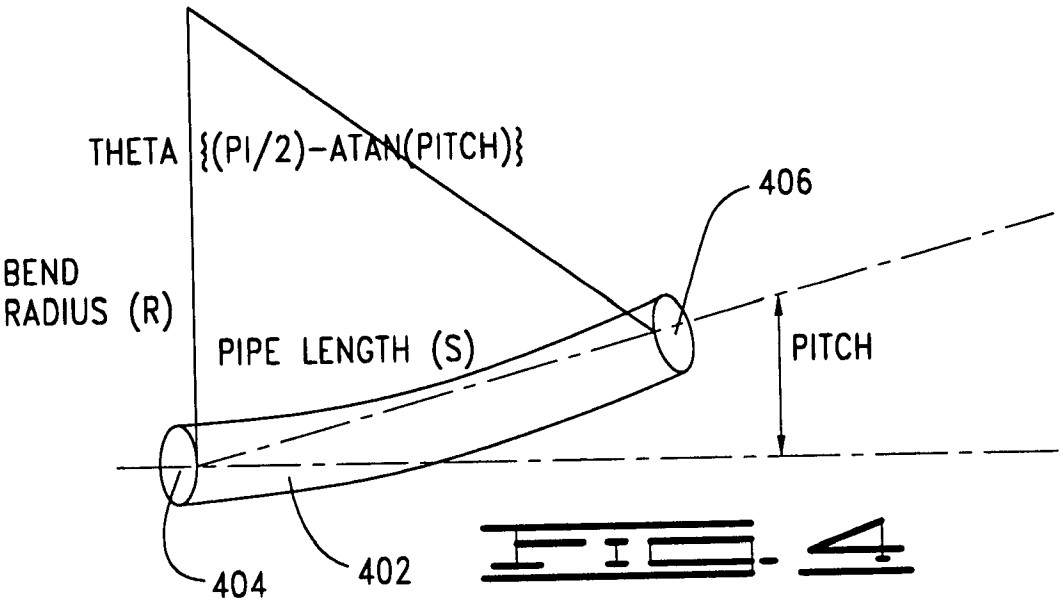
FIG. 4 is a view of a pipe bent through a certain curvature.

Now referring to FIG. 4, a representation of a pipe 402 that has been bent through an arc as it moved through the ground is depicted. This bent pipe 402 model is preferably used in the calculations for the path 12 generation to determine the position of the pipe at measurement intervals 38 for the drill string 14 as it is bent along the bore path. This figure displays the pipe 402 bent only in a vertical direction, but would also apply for a bend in a horizontal direction or both the vertical and horizontal directions as well. As depicted, the pipe 402 is of a known length S that generates the path along a curve. Using the position, pitch, and yaw of the pipe 402 at the start of the curve 404, and calculated at the previous measurement interval, and the pitch and yaw as measured at the present measurement interval at the end of the curve 406, the position of the pipe 402 at the present measurement interval can be determined. This new position can then be recorded on the map as the actual position of the boring tool 16.

Figure 5:
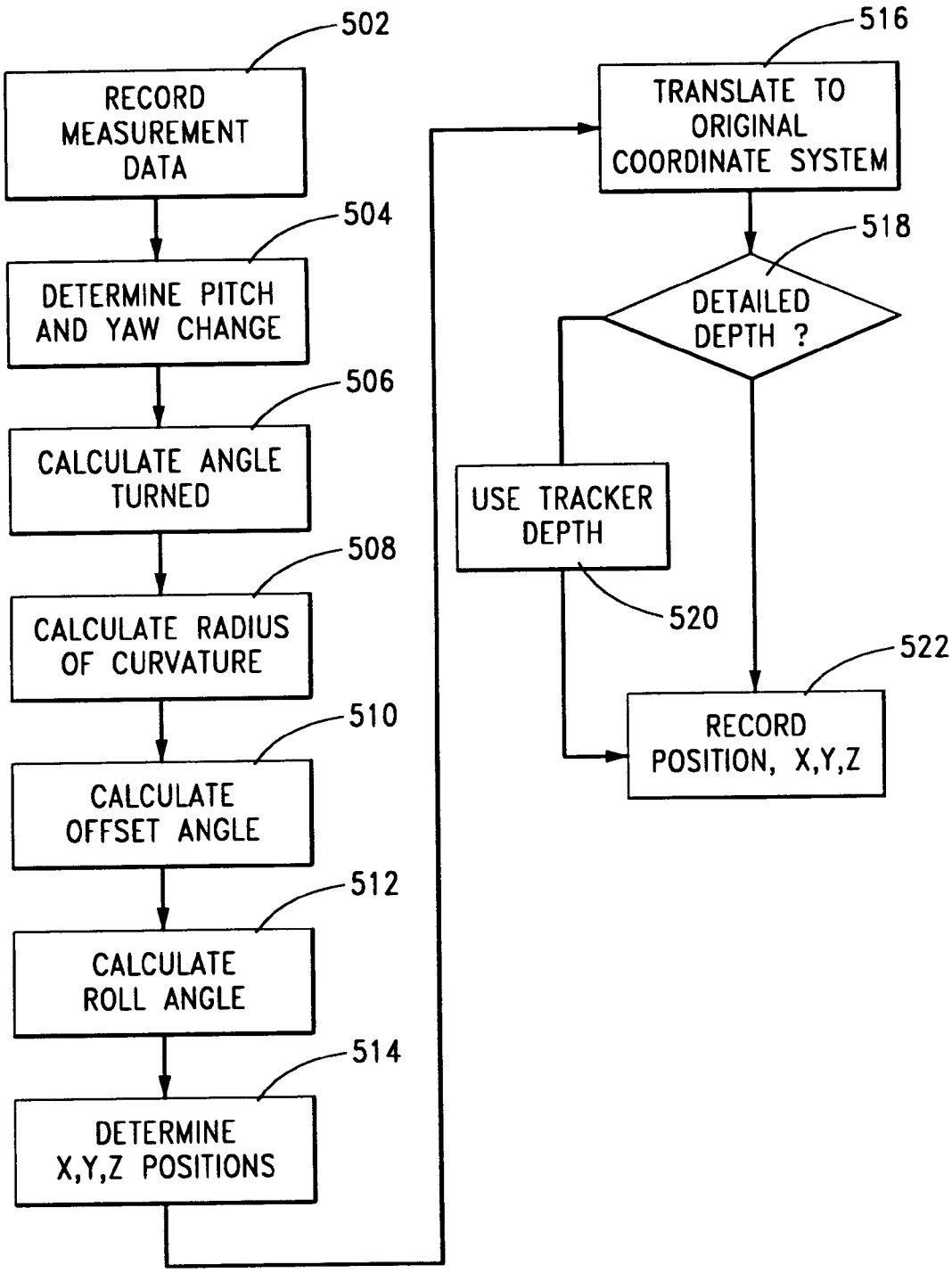
FIG. 5 is a logic flow diagram for the pipe bending model of FIG. 4 used to calculate an end point position of the pipe.
Figure 5:
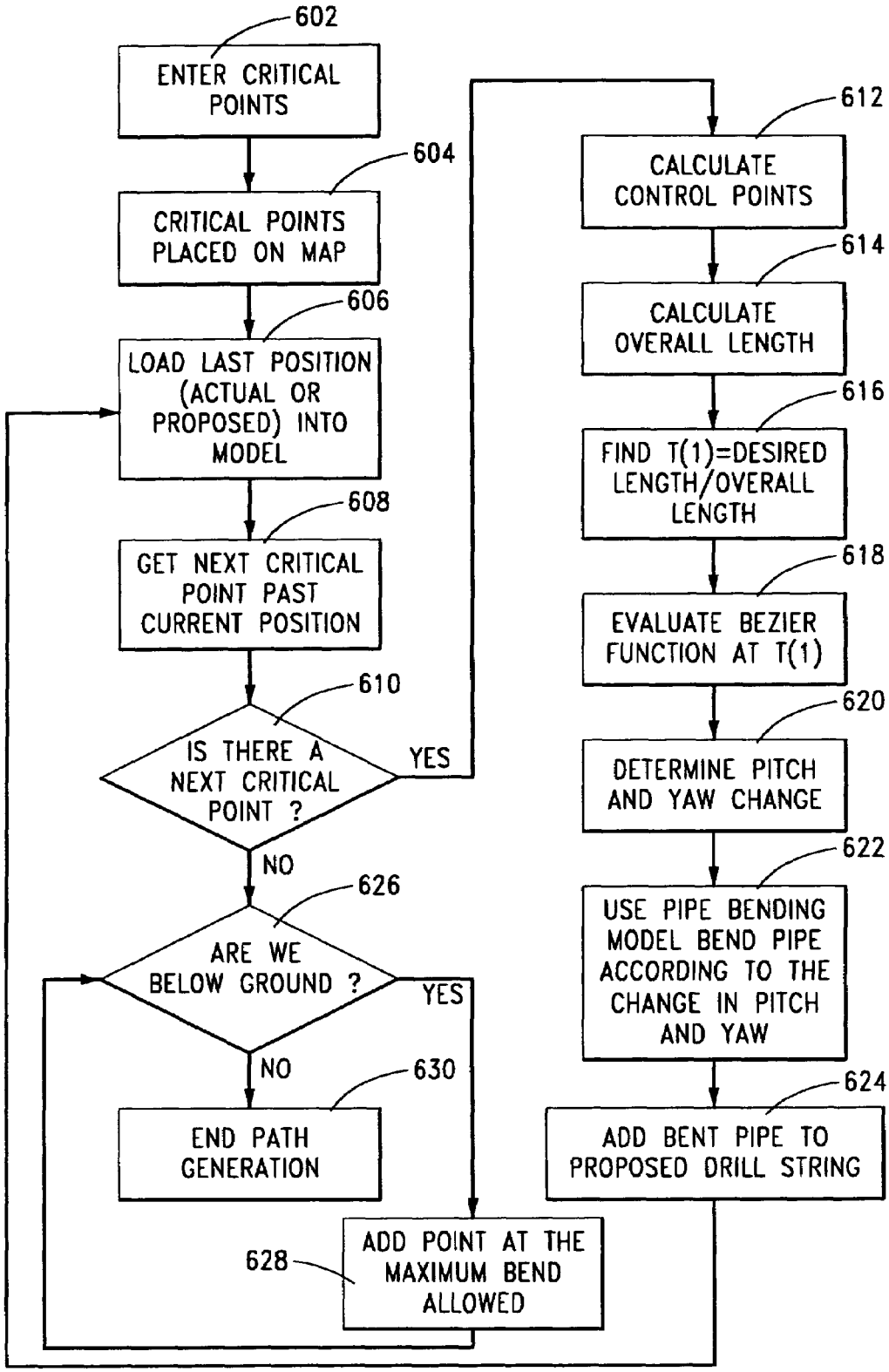

The logic diagram of FIG. 5 illustrates a bending model procedure for calculating the position of the end 406 of the pipe 402 shown in FIG. 4. The procedure assumes that pitch, yaw, and depth of the end 406 of the pipe 402 are measured at 502. First, the change in pitch and yaw, between the previous measured and current measured points, are calculated at 504. Then, the total angle turned by the pipe can be determined at 506. At 508, the radius of curvature of the bend in the pipe is found, for the particular known length S of the pipe. Next at 510, the offset angle for the original placement of the pipe is calculated. At 512, the roll angle is determined from the change in pitch and yaw. Then at 514 the changes in x, y, and z from the previous point are determined. Next at 516, the calculated coordinates are translated to the original coordinate system to determine the change in each of the x, y, and z directions along the curve of the bent pipe. At 518, a determination is made to see if depth measurement is available where a tracking system 18 is used, the depth is greater than 18 inches, and there is inputted topography. If a tracker depth is used, a depth for z is determined at step 520 from the measurement recorded at step 502 and the known inputted topography. This permits depth accuracy to be obtained from the conventional tracking techniques to improve accuracy. Finally, at 522 the new position (x, y, z) is recorded. The result of the procedure shown in FIG. 5 will be an identified coordinate position (x, y, z) for the end of the pipe or measurement interval, and consequently the boring tool 16. Thus, after measuring the pitch and yaw, and knowing the length S of the measurement interval, the new position of the end 406 of the pipe 402 can be calculated from the start position 404 of the pipe.

Shown below is pseudocode for the procedure described in FIG. 5.

```
{Bend Model Calculation for Position}
Set S = Measurement Interval (Pipe Length)
Set θpitch = Pitch1
Set θyaw = Yaw1
Set ΔYaw = Yaw2 − Yaw1
Set ΔPitch = Pitch2 − Pitch1
IF (ΔYaw AND ΔPitch = 0) THEN
    x0 = S * cosθpitch * cosθyaw
    y0 = S * cosθpitch * sinθyaw
    z0 = S * sinθpitch
ELSE
    θtotal = √((ΔYaw)² + (ΔPitch)²)
    Rtotal = S/θtotal
    Set Bend Radius = Rtotal

    φ = tan⁻¹(ΔPitch / ΔYaw)

    θtotal = √((ΔYaw)² + (ΔPitch)²) + −π/2

    x1 = Rtotal * cos(θtotal)
    D = Rtotal + (Rtotal * sin(θtotal))
    y1 = D * cos(φ)
    z1 = D * sin(φ)
    x0 = x1 * cos(θpitch) * cos(θyaw) − y1 * sin(θyaw) −
        z1 * sin(θpitch) * cos(θyaw)
    y0 = x1 * cos(θpitch) * sin(θyaw) + y1 * cos(θyaw) −
        z1 * sin(θpitch) * sin(θyaw)
    z0 = x1 * sin(θpitch) + z1 * cos(θpitch)
END IF
Xresult = Xprevious + x0
Yresult = Yprevious + y0
IF (Detailed Depth Available) THEN
    Calculate z0 from Topography and Measured Depth
ELSE
    Zresult = Zprevious + z0
ENDIF
```

Referring now to FIG. 6, shown therein is a logic flow diagram for the procedure of calculating and displaying a bore path. Initially at 602, the critical points are entered either manually or electronically from information collected about the intended utility installation. The points are then placed on the map at 604. At 606, the software then loads the position for the pipe, which is initially equivalent to the first critical point. The next critical point on the map is then found at 608. If a next critical point has been found 610, then the control points for the Bezier spline are calculated at 612. Next at 614, the length of the spline through the four control points is calculated. At 616, the length of the spline length is divided by the measurement interval to determine the points at which the spline will be evaluated. At 618 the Bezier spline is evaluated at the interval points to determine the position data for the end of each pipe. The pitch and yaw are then determined for the spline point at 620. At 622, the position, pitch, and yaw information is then used with a pipe bending model to determine the pitch and yaw at the end of the measurement interval. This portion of the pipe bending is then added to the calculated bore path at 624 and the software loops back to step 606. In the next iteration of the software at 606, the calculated point is loaded as the first control point for the next calculation. This will continue until the path is calculated through all of the critical points.

When the path through each critical point has been calculated, the software determines at 626 whether or not the path is still below ground. If the path is still below ground, a path out of the ground is generated at 628 at the maximum allowable bend characteristic for the drill pipes. When the path is out of the ground, the path generation is completed at 630.

Shown below is pseudocode for the process of generating the path as described above.

```
    {Generate Path}
    Record First Measurement
For each Measurement in the List of Measurements Taken
    Calculate Position (using Bending Model)
Set First Critical Point (prev) = last Observation
Find Next Critical Point (target) such that (target > prev)
WHILE (target Exists) THEN
    DO
        Load parameters into Drill Pipe Calculator
        Initialize Drill Pipe Calculator
        Calculate Position and Drilling Instructions
            (using Position Between Critical Points)
        Add Proposed Pipe
        Set prev = Added pipe
    WHILE (Prev < Target)
    Get Next Critical Point (target) such that (target > prev)
END WHILE
Add Pipe to go past last critical point
Set prev = Pipe
WHILE (prev.Depth < Terrain) THEN
    Set Pipe.Pitch = Max Allowable Pitch Change
    Calculate Position (using Bending Model)
    Add Pipe
    Set prev = Pipe
END WHILE
```

Figure 7:
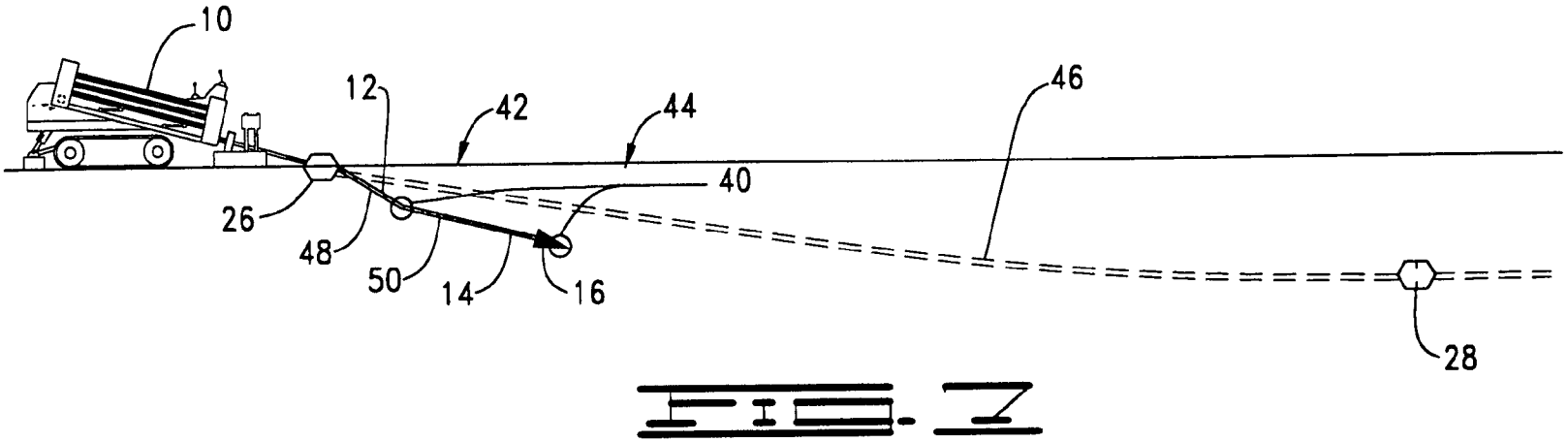
FIG. 7 is a side view of a bore path with positions recorded for actual drilling of pipes.

With reference now to FIG. 7, there is shown therein a map of a bore that has had recordings of the downhole system taken at the end of each pipe. Two pipes 48 and 50 have been recorded at the start of the bore, represented by recorded endpoints 40 and flags 42 and 44 showing where measurements have been taken. The bore path 12 for these two pipes can be seen relative to the intended path 46. These actual recordings then show where the boring tool 16 is currently with respect to the intended path 46 and the critical points 26 and 28. As discussed above, each recording of a pipe or measurement interval is based upon the position of the measurement recording being the starting point for the next interval of path that is followed.

Figure 8:
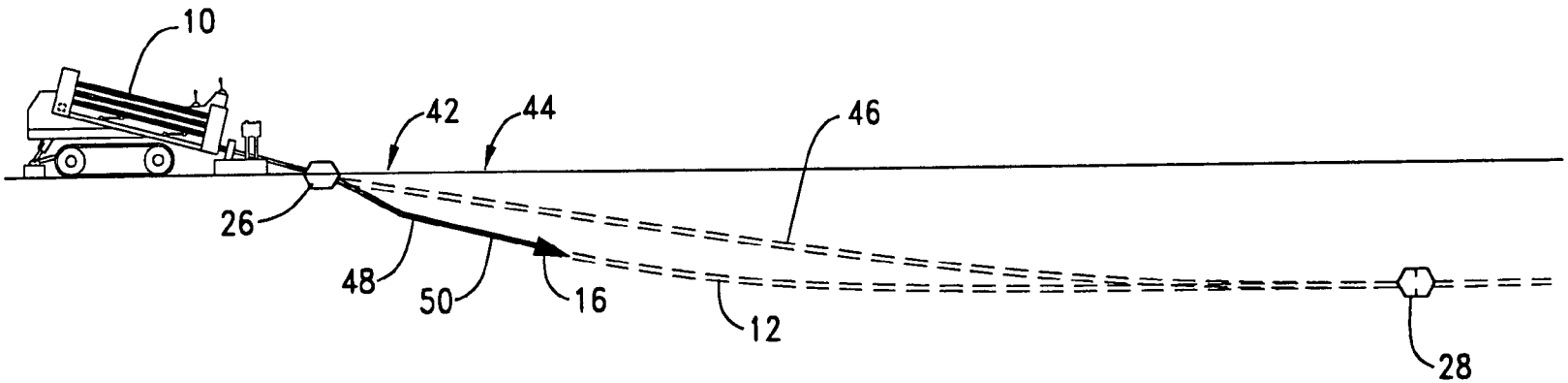
FIG. 8 is a side view of the bore of FIG. 7 with a new path generated after recording the actual drilling of pipes.
Figure 3:
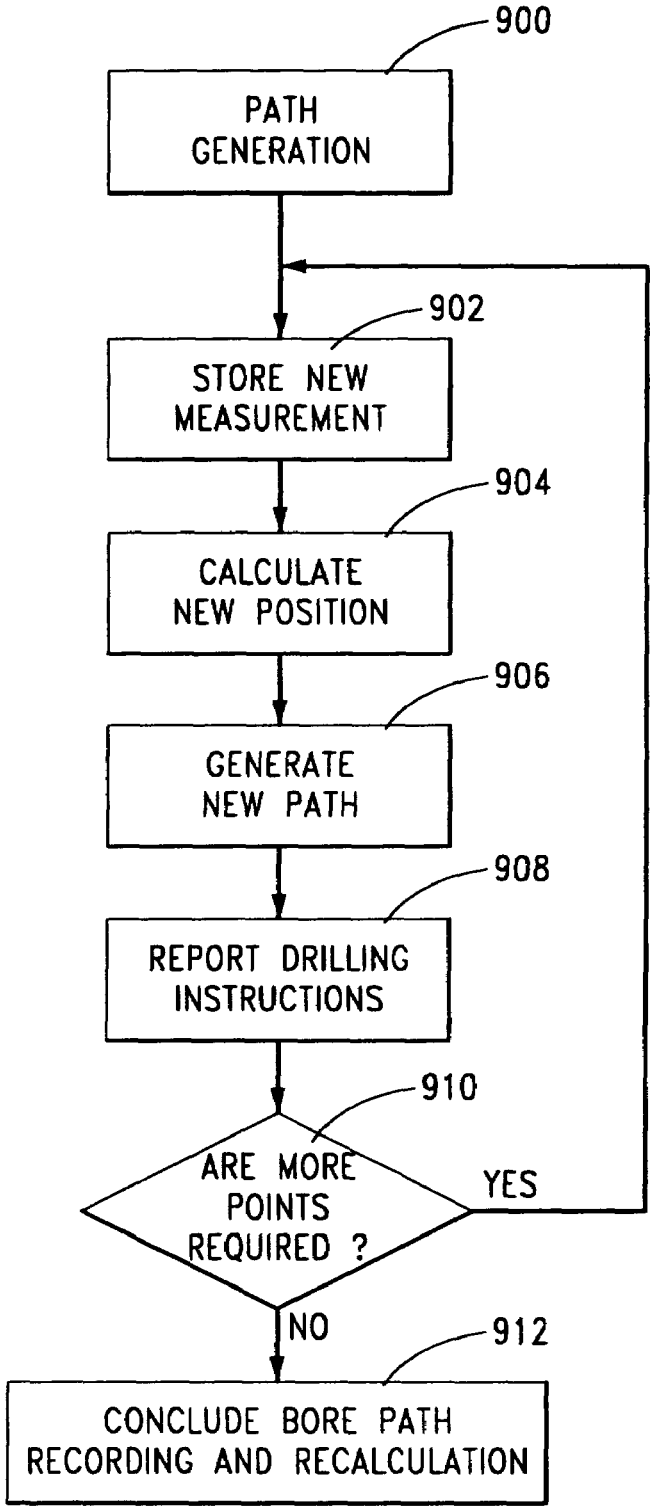

In FIG. 8 there is shown a record of the bore information from FIG. 7 with the additional showing of the corrected bore path 12 that has been calculated. The new bore path 12 shown has been calculated using as the new starting position the end of the last pipe that is in the ground. Calculating the new bore path 12 in accordance with the present invention does not force the drilling system back to the original path, but automatically calculates a new path through the critical points 26 and 28 for the bore. The bore will then proceed based on the new bore path 12 as generated.

FIG. 9 illustrates logic for the automatic path generation and calculation process. At step 902, information about a new measurement is stored. One skilled in the art would understand a new measurement could also be reflected by removing a pipe and deleting a measurement from the measurements previously stored. As previously described, this information would include pitch, yaw, and depth information taken at a particular measurement interval. The new position of the boring tool 16 is then calculated at 904 using the previous position as a start point and using the pipe bend characteristics and bend model calculations. At step 906, the new path 12 is generated using as a starting point the position that was calculated at 904. The path generation procedure will again involve evaluating of a Bezier spline and four control points as previously described to determine the path 12, and evaluating the spline at each measurement interval. The result from this step is identification of a new bore path 12, beginning at the latest known position of the boring tool and concluding at the desired end path of the original plan. At step 908, drilling instructions and orientation data for the next measurement point are communicated. The drilling instructions may include roll orientation, pitch, yaw, and distance for the next segment. The drilling information may be reported either to an operator or a control system for the actual implementation. The software then checks at step 910 to see if the bore is completed. If more drilling points are required, the procedure loops back to step 902 to wait on the next measurement. This loop of the procedure would be repeated until the bore path is completed. If the bore is found to be complete 910, then the software concludes the bore path recording and recalculation process at 912.

As shown in the logic from FIG. 9, the invention comprises a method for continuous path generation for a horizontal borehole. The method comprises automatically generating the path through the identified critical points, reporting the drilling instructions for a measurable interval, and implementing the necessary procedures for the drilling instructions. When new measurements are taken at the end of a length of pipe or otherwise, the measurements are recorded, the position of the boring tool is determined, and a new bore path is automatically calculated based upon the current determined position of the boring tool. The measurement and path calculation procedure will then continue until the bore is completed.

As shown in FIG. 9, in accordance with an embodiment of the present invention drilling instructions may be issued for guiding the boring tool 16 to the next measurement point. The drilling instructions may be transmitted either to a machine control system used to automatically operate the boring machine 10 or an operator for implementation. The machine control system or the operator will then use the normal information available from the downhole electronics guidance system to reach the next measurement point by either changing direction, boring straight, or a combination of both through conventional boring methods. After the machine control system or operator performs the next interval of drilling, the next measurement is recorded. The software then recalculates the path and restarts the process by transmitting a new set of drilling instructions. This process is then repeated until the bore is finished.

Those skilled in the art will appreciate that variations from the specific embodiments disclosed above are contemplated by the invention. The invention should not be restricted to the above embodiments and is capable of modifications, rearrangements, and substitutions of parts and elements without departing from the spirit and scope of the invention.

What is claimed is:

1. A method for drilling a horizontal underground borehole, the method comprising:

recording an orientation of a boring tool located below ground;

calculating a projected position of the boring tool below ground using a bending model; and calculating a bore path from the projected position of the boring tool to a predetermined exit point.

2. The method of claim 1 wherein the orientation of the boring tool comprises a pitch and a yaw of the boring tool.

3. The method of claim 1 wherein the projected position of the boring tool comprises a location of the boring tool in a horizontal plane and a depth of the boring tool.

4. The method of claim 1 further comprising the step of identifying at least one critical point through which the bore path must pass, wherein the critical point comprises a desired depth, a location in a horizontal plane, a pitch, and a yaw for the boring tool at the critical point.

5. The method of claim 1 wherein the step of calculating a bore path comprises:

using a Bezier spline with control points to calculate a curve for the bore path;

segmenting the bore path into measurement intervals;

integrating along the path based on the measurement intervals; and identifying location, depth, pitch, and yaw information for each measurement interval.

6. The method of claim 1 further comprising the step of transmitting instructions for guiding the boring tool along a next segment of the boring path.

7. The method of claim 6 wherein the next segment of the boring path is represented by a straight segment or a curve.

8. The method of claim 7 wherein the instructions for guiding the boring tool comprise a distance for boring in a straight line or a distance, pitch, and yaw for boring on a curve.

9. The method of claim 7 wherein the instructions for guiding the boring tool comprise a distance for boring in a straight line or a distance and roll orientation for boring on a curved path.

10. The method of claim 6 wherein the instructions for guiding the boring tool are transmitted to a control system for a boring machine.

11. The method of claim 1 further comprising the step of recording an actual path bored by the boring tool.

12. The method of claim 11 wherein the step of recording an actual path bored comprises:

recording a depth, pitch, and yaw of the boring tool at a plurality of measurement intervals;

calculating a location of the boring tool in a coordinate system at the plurality of measurement intervals; and displaying a path through a plurality of points represented by the location and depth of the boring tool at the plurality of measurement intervals.

13. A method for drilling a horizontal underground borehole with a boring tool, the method comprising:

measuring a depth, pitch, and yaw of the boring tool;

calculating a projected position of the boring tool using a bending model;

calculating a bore path from the projected position of the boring tool to a next critical point; and calculating drilling instructions for the boring tool along a next segment of the bore path.

14. The method of claim 13 further comprising selecting a plurality of critical points for an underground borehole.

15. The method of claim 13 further comprising guiding the boring tool in response to the drilling instructions.

16. A method for drilling a horizontal underground borehole, the method comprising:

recording an orientation of a boring tool located below ground;

calculating a projected position of the boring tool below ground using a bending model; and calculating a bore path represented by a cubic spline from the projected position of the boring tool to a predetermined exit point.

17. The method of claim 16 wherein the orientation of the boring tool comprises a pitch and a yaw of the boring tool.

18. The method of claim 16 wherein the projected position of the boring tool comprises a location of the boring tool in a horizontal plane and a depth of the boring tool.

19. The method of claim 16 further comprising the step of identifying at least one critical point through which the bore path must pass, wherein the critical point comprises a desired depth, a location in a horizontal plane, a pitch, and a yaw for the boring tool at the critical point.

20. The method of claim 16 wherein the step of calculating a bore path comprises:

using a Bezier spline with control points to calculate the spline for the bore path;

segmenting the bore path into measurement intervals;

integrating along the path based on the measurement intervals; and identifying location, depth, pitch, and yaw information for each measurement interval.

21. The method of claim 16 further comprising the step of transmitting instructions for guiding the boring tool along a next segment of the boring path.

22. The method of claim 21 wherein the next segment of the boring path is represented by a straight segment or a curve.

23. The method of claim 22 wherein the instructions for guiding the boring tool comprise a distance for boring in a straight line or a distance, pitch, and yaw for boring on a curve.

24. The method of claim 22 wherein the instructions for guiding the boring tool comprise a distance for boring in a straight line or a distance and roll orientation for boring on a curved path.

25. The method of claim 21 wherein the instructions for guiding the boring tool are transmitted to a control system for a boring machine.

26. The method of claim 16 further comprising the step of recording an actual path bored by the boring tool.

27. The method of claim 26 wherein the step of recording an actual path bored comprises:

recording a depth, pitch, and yaw of the boring tool at a plurality of measurement intervals; and calculating a location of the boring tool in a coordinate system at the plurality of measurement intervals.

28. The method of claim 27 further comprising the step of displaying a path through a plurality of points represented by the location and depth of the boring tool at the plurality of measurement intervals.

29. A method for drilling a horizontal underground borehole with a boring tool, the method comprising:

measuring a depth, pitch, and yaw of the boring tool;

calculating a projected position of the boring tool using a bending model;

calculating a bore path represented by a cubic spline from the projected position of the boring tool to a next critical point; and calculating drilling instructions for the boring tool along a next segment of the bore path.

30. The method of claim 29 further comprising selecting a plurality of critical points for an underground borehole.

31. The method of claim 29 further comprising guiding the boring tool in response to the drilling instructions.

32. The method of claim 29 further comprising transmitting the drilling instructions to a control system.

* * * * *